United States Patent [19]

Kurzendoerfer et al.

[11] Patent Number: 4,861,516

[45] Date of Patent: Aug. 29, 1989

[54] LAUNDRY PRETREATMENT COMPOSITION FOR OILY AND GREASY SOIL

[75] Inventors: Claus-Peter Kurzendoerfer, Duesseldorf; Winfried Wichelhaus, Mettmann, both of Fed. Rep. of Germany

[73] Assignee: Henkel Kommanditgesellschaft auf Aktien, Duesseldorf, Fed. Rep. of Germany

[21] Appl. No.: 184,736

[22] Filed: Apr. 22, 1988

[30] Foreign Application Priority Data

Apr. 25, 1987 [DE] Fed. Rep. of Germany ..... 3713962

[51] Int. Cl.[4] ..... C11D 1/14; C11D 3/075

[52] U.S. Cl. ..... 252/531; 252/135; 252/155; 252/170; 252/171; 252/173; 252/174.21; 252/174.21; 252/174.22; 252/547; 252/550; 252/DIG. 2; 252/DIG. 14

[58] Field of Search ..... 252/89.1, 174.21, 174.22, 252/170, 171, 550, DIG. 14

[56] References Cited

U.S. PATENT DOCUMENTS

| | | | |
|---|---|---|---|
| 3,619,119 | 11/1971 | Felletschin et al. | 8/137 |
| 3,983,078 | 9/1976 | Collins | 252/540 |
| 4,123,378 | 10/1978 | Abel et al. | 252/171 |
| 4,199,482 | 4/1980 | Renaud et al. | 252/559 |
| 4,234,444 | 11/1980 | Wegener et al. | 252/174.22 |
| 4,338,212 | 7/1982 | Wegener et al. | 252/174.22 |
| 4,438,009 | 3/1984 | Brusky et al. | 252/90 |
| 4,588,516 | 5/1986 | Schwartz | 252/174.21 |
| 4,659,332 | 4/1987 | Hellsten | 8/142 |

FOREIGN PATENT DOCUMENTS 58508 5/1978 Japan .

*Primary Examiner*—Prince E. Willis

*Attorney, Agent, or Firm*—Ernest G. Szoke; Wayne C. Jaeschke; Real J. Grandmaison

[57] ABSTRACT

A laundry pretreatment composition comprising an invertmicellar ternary mixed phase containing from 5 to 15% by weight of at least one anionic surfactant or from 25 to 45% by weight of at least one nonionic surfactant, and from 50 to 55% by weight of at least one cosurfactant in the presence of an anionic surfactant or from 35 to 50% by weight of at least one cosurfactant in the absence of anionic surfactant, and from 45 to 30% by weight of water in the presence of anionic surfactant and from 40 to 5% by weight of water in the absence of anionic surfactant.

13 Claims, No Drawings

LAUNDRY PRETREATMENT COMPOSITION FOR OILY AND GREASY SOIL

BACKGROUND OF THE INVENTION

Field of the Invention

This invention relates to a laundry pretreatment composition which is suitable for the treatment of heavily oil- and grease-soiled portions of laundry articles which are subsequently washed in the customary way. Compositions of the type herein enhance the effect of the detergent with respect to difficult soil types which, in general, are not adequately removed in the so-called "delicates" program at 30° to 40° C. or in the "easy-care" program at 50° to 60° C. of a laundry machine.

Laundry pretreatment compositions of the type herein have to satisfy a number of requirements which are not all met by known compositions. These requirements include:

1. specific dissolving power for fats, oils and waxes,
2. avoidance of ring formation from soil areas spreading across the fabrics,
3. complete removability during the subsequent washing process, i.e the surfactant components used should not leave any greasy marks behind on the fabrics after the washing process,
4. avoidance of foaming during the subsequent washing process,
5. non-toxicity to humans and domestic animals,
6. adequate biodegradability of the detergent components used in the wastewater,
7. the composition should be formulated in such a way that there is no need for fluorinated hydrocarbons to be used as propellants.

Accordingly, an object of the present invention is to provide a new laundry pretreatment composition which is particularly suitable for the removal of oily and greasy soil and, at the same time, is free from environment-polluting halogenated hydrocarbons.

DESCRIPTION OF THE INVENTION

Other than in the operating examples, or where otherwise indicated, all numbers expressing quantities of ingredients or reaction conditions used herein are to be understood as modified in all instances by the term "about".

The present invention relates to laundry pretreatment compositions containing new ternary mixtures of surfactants, cosurfactants and water which are particularly suitable for removing oily and greasy soil from fabrics. Cosurfactants are generally amphiphilic compounds which enhance the emulsifying power of surfactants.

The afore-mentioned requirements are satisfied by a laundry pretreatment composition for oily and greasy soil which comprises;

(a) from 5 to 15% by weight of at least one anionic surfactant selected from the group consisting of $C_{12}$–$C_{18}$ alkali metal alkylsulfates, or
from 25 to 45% by weight of at least one nonionic surfactant selected from the group consisting of alkyl polyglycol ether and alkylphenol polyglycol ether respectively containing 6 to 10 ethylene oxide groups, the alkyl alcohol groups containing from 12 to 18 carbon atoms and the alkyl phenol groups from 8 to 9 carbon atoms in the alkyl portion, or
from 5 to 15% by weight of a mixture of at least one of the above-mentioned anionic surfactants and at least one of the above-mentioned nonionic surfactants, the anionic surfactant component making up at least two thirds of the mixture, (b) from 50 to 55% by weight of at least one cosurfactant in the presence of anionic surfactants, and from 35 to 50% by weight of at least one cosurfactant in the absence of anionic surfactants, said cosurfactant consisting of $C_5$ or $C_6$ monoalcohols or adducts thereof optionally containing up to 2 ethylene oxide groups, and (c) from 45 to 30% by weight of water in the presence of anionic surfactants, and from 40 to 5% by weight of water in the absence of anionic surfactants, all weights being based on the weight of said composition, and wherein said composition is in the form of an invertmicellar ternary mixed phase.

Besides inhomogeneous regions, phase diagrams of surfactant/cosurfactant/water mixtures show three characteristic homogeneous mixed phase regions, namely (1) an aqueous micellar solution, which is also known as the $L_1$ phase, (2) a highly viscous liquid crystal phase (D phase) and (3) an invert-micellar solution which is also known as the $L_2$ phase.

Micellar and invert-micellar mixed phases are thermodynamically stable and optically clear phases which are cable of "microemulsifying" oils. Oil-in-water (o/w) microemulsions are formed from $L_1$ phases and water-in-oil (w/o) microemulsions from $L_2$ phases, representing homogeneous isotropic phases stable at room temperature which, even when diluted with water, remain stable for at least a short time. The oil-in-water and water-in-oil microemulsions formed from the $L_1$ phase and the $L_2$ phase may be differentiated, for example by conductivity measurements.

It is assumed that the emulsifying power of the ternary mixed phases $L_1$ and $L_2$ jointly determines the detergent effect of such mixtures. However, it is surprising that, where the surfactants and cosurfactants according to the invention are used, the invertmicellar $L_2$ phase shows much more detergent activity than the other mixtures. The invert-micellar phase having the composition according to the invention has proved to be particularly effective in this regard.

In a preferred embodiment, a dodecyl polyglycol ether is used as the alkyl polyglycol ether, although hexadecyl or octadecyl polyglycol ether may also be used. The preferred alkyphenol in alkyphenol polyglycol ethers is nonylphenol.

The laundry pretreatment compositions according to this invention have a particularly advantageous effect where alkali metal salts, preferably the sodium salt of hexadecyl sulfate, are used as the anionic surfactant, and dodecyl alcohol containing 8 ethylene oxide groups or nonylphenol containing 9 ethylene oxide groups is used as the nonionic surfactant.

Another preferred embodiment of the laundry pretreatment composition according to the invention is characterized in that the cosurfactant is selected from the group consisting of pentanol and hexanol and slightly ethoxylated adducts thereof, i.e. adducts containing up to 2 moles and preferably 1 to 2 moles of ethylene oxide groups. The low ethoxylation also leads to substantial elimination of the odor of the alkanols.

The laundry pretreatment compositions may contain thickeners to increase their viscosity. Suitable thickeners for invertmicellar ternary mixed phases in the laundry pretreatment compositions include natural and synthetic hectorites charged with tetraalkylammonium compounds. These hectorites are charged with from about 30 to about 40% by weight of dialkyl dimethyl compounds containing alkyl radicals, such as cetyl or stearyl radicals, and may be used in the ternary mixed phases, i.e. containing anionic surfactant, nonionic surfactant or even the mixture of anionic and nonionic surfactant, in quantities of up to 15% by weight and preferably in quantities of from 9 to 15% by weight. Such alkyl radicals include distearyl dimethyl, and dicetyl dimethyl, for example, in ammonium chloride compounds. The thickening of the low viscosity invert-micellar mixed phases with hectorite additionally improves the detergent effect of the compositions.

In another embodiment, the laundry pretreatment compositions may contain added sodium triphosphate, in which case the laundry pretreatment composition according to the invention is characterized in that it contains up to 1% by weight and preferably from 0.2 to 1% by weight of sodium triphosphate, based on the water content of said composition. Sodium triphosphate enhances the removal of pigments.

The present invention also relates to a process for the pretreatment of laundry using the laundry pretreatment compositions in accordance with this invention.

In addition, the laundry pretreatment compositions may contain standard additives such as, for example, preservatives and perfume, preferably in quantites of from 0.01 to 1% by weight, based on the weight of the compositions.

Mixed phases according to the invention are prepared by stirring the liquid cosurfactant into the surfactant solutions, surfactant dispersions or surfactant emulsions.

In the following examples, "EO" stands for added moles of ethylene oxide. The percentages are percentages by weight.

The mixed phase compositions according to the invention of the following examples were prepared by stirring the particular cosurfactant into the respective surfactant solution, dispersion or emulsion.

The detergent effect of the mixed phase compositions was determined at room temperature on olive oil/cotton and sebum/cotton test fabrics with colored oil and grease. The mixed phase composition was applied and, after a contact time of 15 minutes, was rinsed off the fabric under running tapwater. After drying in air, the degree of light remission of the fabric was measured as a measure of the detergent effect. The following compositions were prepared:

EXAMPLE 1

(a) 15% dodecyl sulfate Na salt,
(b) 55% pentanol,
(c) 30% water.

EXAMPLE 2

(a) 15% hexadecyl sulfate Na salt,
(b) 50% pentanol,
(c) 35% water.

EXAMPLE 3

(a) 15% hexadecyl sulfate Na salt,
(b) 55% hexanol,
(c) 30% water.

EXAMPLE 4

(a) 15% hexadecyl sulfate Na salt,
(b) 50% hexanol containing 1.4 EO,
(c) 35% water.

EXAMPLE 5

(a) 30% dodecyl alcohol containing 8 EO,
(b) 50% pentanol,
(c) 20% water.

EXAMPLE 6

(a) 40% nonylphenol containing 9 EO,
(b) 40% pentanol,
(c) 20% water.

Compared with a conventional commercial aqueous prespotting composition and a liquid detergent used as a stain remover, the mixed phase compositions of Examples 1 to 6 provided a detergent effect stronger by about 17 remission units on the test fabrics soiled with the oily and greasy soils. By virtue of the stability of the mixed phases, the ternary mixtures are storable products. The mixed phase compositions have a high soil suspending power for oils and fats; i.e. rinsing off is possible without troublesome reabsorption of oil and grease.

EXAMPLE 7

The detergency of the invert-micellar mixed phase compositions was also tested against pigment-containing oily soils. When a laundry pretreatment composition according to Example 4 as the reference composition was used on a pigment/olive oli/polyester fabric, it was found that the detergency of a mixed phase composition containing sodium thiophosphate is enhanced by about 14 remission units by the addition of a synthetic layer silicate of the hectorite class as in the following formulation:

(a) 13.6% hexadecyl sulfate Na salt,
(b) 45.5% hexanol containing 1.4 EO,
(c) 31.8% sodium triphosphate solution (concentration 10 g/l)
(d) 9.1% hectorite; charged with 36% by weight ditallowalkyl dimethyl ammonium chloride The detergency of even a conventional, commercially available aqueous laundry pretreatment composition is thus clearly surpassed.

We claim:

1. A laundry pretreatment composition for oily and greasy soil comprising:

(a) from about 5 to about 15% by weight of at least one anionic surfactant selected from the group consisting of $C_{12}$–$C_{18}$ alkali metal alkylsulfate, or from about 25 to 45% by weight of at least one nonionic surfactant selected from the group consisting of alkyl polyglycol ether and alkylphenol polyglycol ether respectively containing from about 6 to about 10 ethylene oxide groups, the alkyl alcohol groups containing from about 12 to about 18 carbon atoms and the alkyl phenol groups from about 8 to 9 carbon atoms in the alkyl portion, or from about 5 to about 15% by weight of a mixture of at least one of said anionic surfactant and at least one of said nonionic surfactant, the anionic surfactant component making up at least two thirds of said mixture, (b) from about 50 to about 55% by weight of at least one cosurfactant in the presence of said anionic surfactant, and from about 35 to about 50% by weight of at least one cosurfactant in the absence of said anionic surfactant, said cosurfactant consisting of a $C_5$ or $C_6$ monoalcohol or adduct thereof containing from about 1 to about 2 ethylene oxide groups, and (c) from about 45 to about 30% by weight of water in the absence of said anionic surfactant, all weights being based on the weight of said composition, and wherein said composition is in the form of an invertmicellar ternary mixed phase.

2. A laundry pretreatment composition as in claim 1 wherein said alkali metal alkyl sulfate comprises sodium hexadecyl sulfate.

3. A laundry pretreatment composition as in claim 1 wherein said nonionic surfactant is selected from dodecyl alcohol containing 8 ethylene oxide groups and nonylphenol containing 9 ethylene oxide

4. A laundry pretreatment composition as in claim 1 including up to about 1% by weight sodium triphosphate, based on the water content of said composition.

5. A laundry pretreatment composition as in claim 1 including from about 9 to about 15% by weight of a hectorite charged with from about 30 to about 40% by weight of distearyl dimethyl ammonium chloride or dicetyl dimethyl ammonium chloride.

6. A laundry pretreatment composition as in claim 1 wherein said alkyl polyglycol ether is selected from hexadecyl, octadecyl and dodecyl polyglycol ether.

7. A laundry pretreatment composition as in claim 1 including from about 0.01 to about 1% by weight of preservative and perfume.

8. A process for the pretreatment of a fabric soiled with oily or greasy coil comprising contacting said fabric with a composition containing:

(a) from about 5 to about 15% by weight of at least one anionic surfactant selected from the group consisting of $C_{12}$–$C_{18}$ alkali metal alkylsulfate, or from about 25 to about 45% by weight of at least one nonionic surfactant selected from the group consisting of alkyl polyglycol ether and alkylphenol polyglycol ether respectively containing from about 6 to about 10 ethylene oxide groups, the alkyl alcohol groups containing from about 12 to about 18 carbon atoms and the alkyl phenol groups from about 8 to 9 carbon atoms in the alkyl portion, or from about 5 to about 15% by weight of a mixture of at least one of said anionic surfactant and at least one of said nonionic surfactant, the anionic surfactant component making up at least two thirds of said mixture, (b) from about 50 to about 55% by weight of at least one cosurfactant in the presence of said anionic surfactant, said cosurfactant consisting of a $C_5$ or $C_6$ monoalcohol or adduct thereof containing from about 1 to about 2 ethylene oxide groups, and (c) from about 45 to about 30% by weight of water in the presence of said anionic surfactant and from 40 to 5% by weight of water in the absence of said anionic surfactant, all weights being based on the weight of said composition, and wherein said composition is in the form of an invertmicellar ternary mixed phase.

9. A process as in claim 8 wherein said alkali metal alkyl sulfate comprises sodium hexadecyl sulfate.

10. A process as in claim 8 wherein said nonionic surfactant is selected from dodecyl alcohol containing 8 ethylene oxide groups and nonylphenol containing 9 ethylene oxide groups.

11. A process as in claim 8 wherein said composition contains up to about 1% by weight of sodium triphosphate, based on the water content of said composition.

12. A process as in claim 8 wherein said composition contains from about 9 to about 15% by weight of a hectorite charged with from about 30 to about 40% by weight of distearyl dimethyl ammonium chloride or dicetyl dimethyl ammonium chloride.

13. A process as in claim 8 wherein said alkyl polyglycol ether is selected from hexadecyl, octadecyl and dodecyl polyglycol ether.

* * * * *

UNITED STATES PATENT AND TRADEMARK OFFICE

CERTIFICATE OF CORRECTION

PATENT NO. : 4,861,516

DATED : August 29, 1989

INVENTOR(S) : Kurzendoerfer et al.

It is certified that error appears in the above-identified patent and that said Letters Patent is hereby corrected as shown below:

In Claim 3, at Col. 5, line 14, after " 9 ethylene oxide" add --groups--.

Signed and Sealed this

Fifteenth Day of January, 1991

*Attest:*

HARRY F. MANBECK, JR.

*Attesting Officer*

*Commissioner of Patents and Trademarks*